United States Patent [19]

Wexell et al.

[11] Patent Number: 4,632,317

[45] Date of Patent: Dec. 30, 1986

[54] METHOD AND DEVICE FOR DISINTEGRATING COARSE MATERIAL

[76] Inventors: Harry W. Wexell, Floravägen 6, S-802 28 Gävle; Franz B. Wroblewski, Granitvägen 8, S-828 00 Söderhamn, both of Sweden

[21] Appl. No.: 466,350

[22] PCT Filed: Jun. 11, 1982

[86] PCT No.: PCT/SE82/00208

§ 371 Date: Feb. 8, 1983

§ 102(e) Date: Feb. 8, 1983

[87] PCT Pub. No.: WO82/04449

PCT Pub. Date: Dec. 23, 1982

[30] Foreign Application Priority Data

Jun. 12, 1981 [SE] Sweden ..... 81039694

[51] Int. Cl.[4] ..... B02C 18/16

[52] U.S. Cl. ..... 241/30; 241/143; 241/251; 241/254.1; 241/260.1; 241/101.7

[58] Field of Search ..... 241/30, 135, 141, 142, 241/143, 220, 222, 224, 225, 235, 260.1, 251, 259.1, 101.7; 198/625, 663, 669, 676

[56] References Cited

U.S. PATENT DOCUMENTS

| | | | |
|---|---|---|---|
| 4,003,115 | 1/1977 | Fisher | 198/676 X |
| 4,040,571 | 8/1977 | Lindeborg | 241/260.1 X |
| 4,339,084 | 7/1982 | Eriksson | 241/260.1 X |

FOREIGN PATENT DOCUMENTS 576216 10/1977 U.S.S.R. .

*Primary Examiner*—Howard N. Goldberg
*Assistant Examiner*—Timothy V. Eley
*Attorney, Agent, or Firm*—Michael L. Harrison

[57] ABSTRACT

Coarse waste such as stumps, lumber from demolition and the like is disintegrated in accordance with a method and device comprising at least two cooperating, essentially parallel screws having threads with disintegrating edges which move in mutually opposite feeding directions so that they tear the waste into pieces.

21 Claims, 6 Drawing Figures

METHOD AND DEVICE FOR DISINTEGRATING COARSE MATERIAL

TECHNICAL FIELD

The present invention relates to a method and a device for desintegrating coarse and voluminous non-friable material, e.g. stumps, peat and waste from clearing, demolition and packing etc. to desirable fractions for e.g. making cellulose, fuel, compost and the like.

PRIOR ART

This type of handling demands large machines with heavy expenses. The machine types, which alrady are available on the market, have heavy consumption of energy and proportionately low production capacity at the same time as they have a limited capacity to accept and desintegrate very bulky material.

A large group of machines for this purpose desintegrate the material by feeding the same toward one or several constrictions by means of one or several parallel screws. This is a very energy demanding method because of the friction in the constriction.

Another group of machines (SE-patent No. 409 420) have screws which above a bottom feed the material forwardly toward stationary dolly knives. A problem herewith is a.o. that the material may stop against the knives. To reduce this problem it is suggested in the patent to intermittently and individually reverse the operation of the screws to feed back the material which possibly have stopped. However, this does not prevent that these machines have defective capacity.

A third group of machines for this purpose operate with propeller like screw members which principally divide the material in a tangential direction against dollies in form of counteracting rotors or fixed projections from surrounding stand walls. Also machines with rapidly rotating striking members e.g. hammer mills have been used to desintegrate coarse waste, but they have limitations regarding the dimension of the material supplied thereto.

THE INVENTION

The present invention relates to a method and a device for desintegrating coarse material to pieces of desirable dimension with lowest possible energy consumption and with as little too fine material as possible.

According to the invention the material is desintegrated in a way which is defined in claim 1. Accordingly, the material will not be fed forwardly by the screws but is torn and crushed between them until it passes through the spaces between the screws. By choosing a suitable dimension of the spaces between the screws, a desirable dimension of the desintegrated material can be obtained. Since the screws have a comparatively small pitch in proportion to the diameter of the screw the tangential operating force is geared up to a many times larger axially operating force. The axial forces in two cooperating screws counteract each other. Accordingly, the material introduced between these screws is effectd by a counteracting force couple tearing the material in its weakest sections into pieces. When the material is desintegrated so that it can fall down through the openings between the screws the material is finally divided and may be transported away.

The above desintegration effect is obtained along the whole slot between two cooperating screws, which gives a larte production capacity with a comparative small energy consumption. The threads on the screws should be blade shaped and slope in the feeding direction and should be covered on the edge with a wear resistant material. Counteracting feeding directions can be provided either by two adjacent screws having different directions of rotation or by screws having opposite threads, i.e. one is right threaded and the other is left threaded.

The division of the material may also be done in several steps, whereby it may pass several sets of cooperating screws with gradually decreasing dimensions and mutual distance.

The characteristics of the device according to the invention appears by claim 6. The screws should be arranged essentially horizontally so that the material owing to the gravitation passes between them. Above the screws a funnel is located and under them an opening for discharge. In the latter also a grid and classifying means may be located.

BRIEF DESCRIPTION OF THE DRAWINGS

FIGS. 5 and 6 show an industrial application of the invention in the form of a mobile construction in which a device according to the invention is built in.

DETAILED DESCRIPTION OF THE INVENTION

Figure 1:
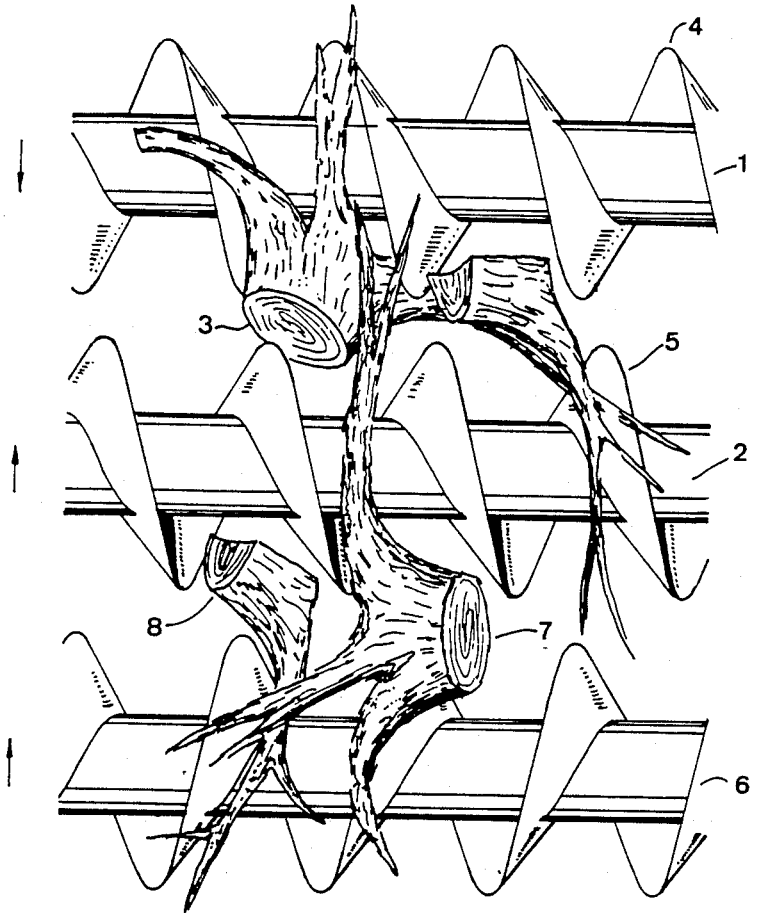
FIG. 1 shows in principle how material is desintegrated according to the invention.

In FIG. 1 two right threaded screws 1, 2 are shown with opposite directions of rotation, which accordingly aim to feed the stump 3 lying on the screws in opposite directions. The threads are blade shaped and slope with the outer edges in the feeding direction. The third screw 6 is left threaded and cooperate with the middle screw 2 and have the same direction of rotation as this. By its direction of rotation the third screw will also aim to pull in the stump 7 between the screws. Accordingly the material will be desintegrated by a combination of cutting, pressing, tearing and bending movements. The obtained pieces 8 pass between the screws.

Figure 4:
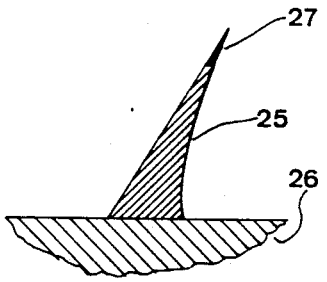
FIG. 4 shows in cross section a preferred shape of the blade thread.
Figure 2:
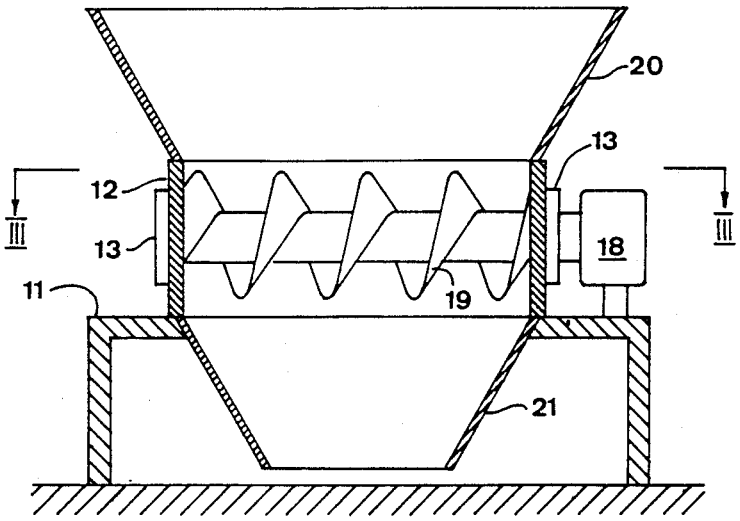
FIGS. 2 and 3 show in vertical and horizontal cross section a construction according to the invention, FIG. 2 showing a cross section along the line II—II in FIG. 3 and FIG. 3 showing a cross section along the line III—III in FIG. 2.
Figure 3:
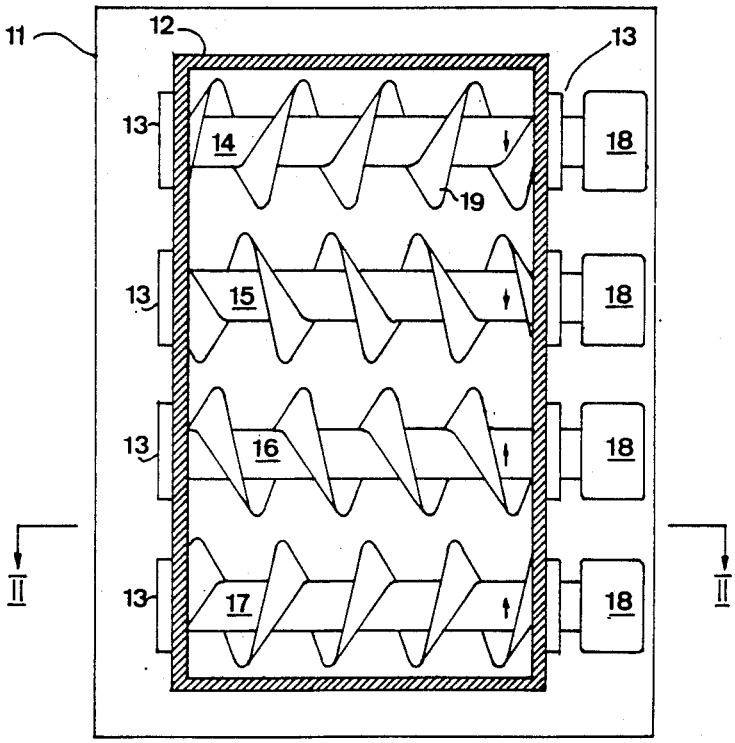

FIGS. 2 and 3 show a device according to the invention located on a stand 11 and comprising a frame 12 with bearings 13 for four screws 14–17. Of these screws, the two in the middle 15, 16, are right threaded and the two outermost 14, 17 left threaded. The screws are operated by motors 18 and their direction of rotation have been indicated by arrows. The threads 19 of the screws are blade shaped and oblique in the feeding direction as is shown in FIG. 4. The material which is to be desintegrated is fed in by a funnel 20 and the desintegrated material falls out through a discharge opening 21.

The blade thread 25 shown in FIG. 4 lean toward the axle 26 on which it is fixed and is provided with a wear resistant edge 27. It is advantageous that the desintegrating edge 27 on the screw in question is active in the feeding direction of the screw. In other words the edge 27 should have a lip or a cutting or shearing portion facing in the feeding direction of the screw so that the edges on two adjacent rotation screws are capable to grip hold of and cut into the material at the same time from two different directions.

Figure 5:
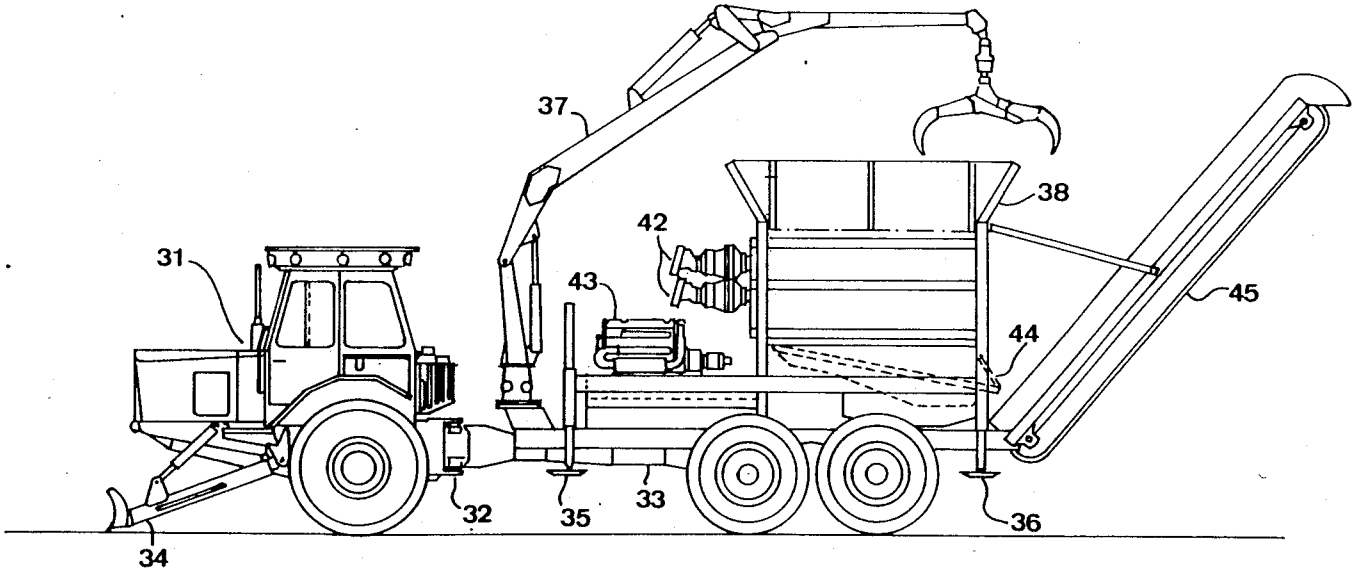
Figure 6:
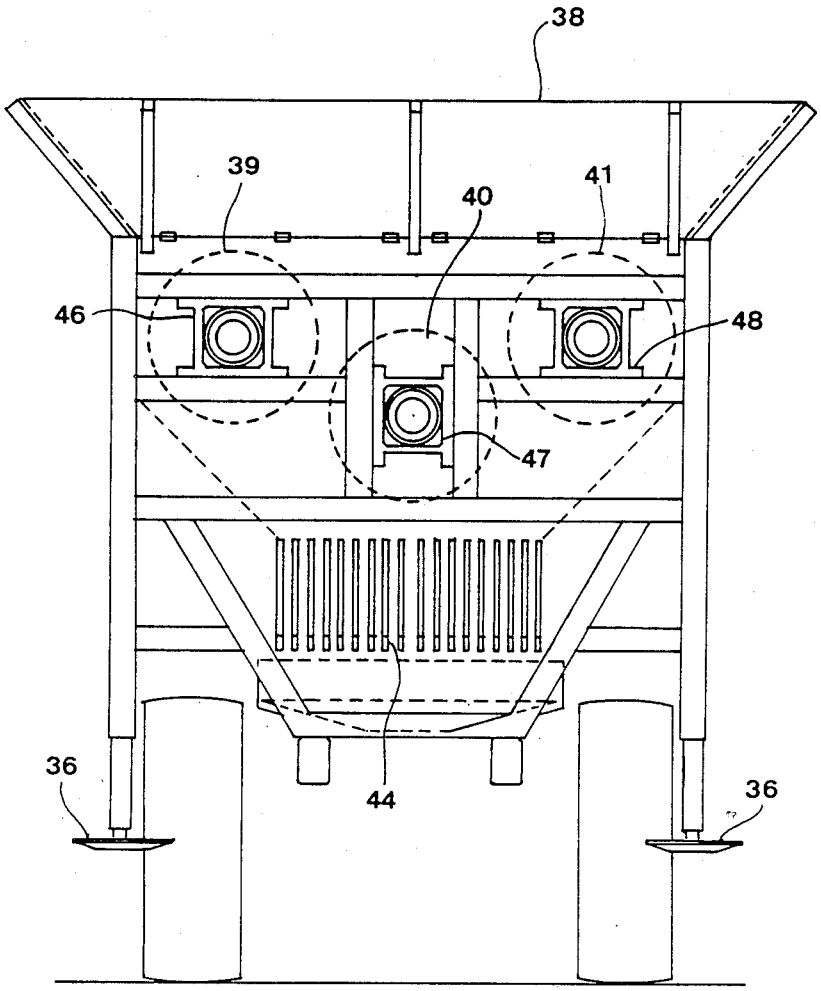

The mobile device shown in FIGS. 5 and 6 consists of a tractor 31 with steering 32 in the middle and connected to a trailer 33. Both are provided with support legs 34, 35, 36. The trailer is provided with a hoisting crane 37 for loading the material, which is to be desintegrated into a funnel 38, which leads to a screw device according to the invention. This consists of three screws 39, 40, 41 operated by hydraulic motors 42. For feeding of these there is a hydraulic assembly 43. Under the screws there is a grid 44, which allow fine material e.g. soil and sand particles to pass through during desintegration of stumps. The more coarse material slides on the grid 44 to a transport device 45 with which the material may be loaded on another vehicle or be put up in a stack. The screw 40 in the middle is located lower than the other two and can if its feeding direction is chosen right assist in feeding out the material on the grid 44. The bearing housings 46, 47, 48 for the screws are displacable and can be adjusted for different degrees of coarseness of the material passing through.

We claim:

1. A method for producing the disintegration of material, which method comprises:

rotating at least two generally adjacent, generally parallel co-operating screws, each of said screws having threads which have disintegrating edges which are active in the direction of advancement of the thread during rotation and arranged so that each screw has a direction of thread advancement which is opposite to that of any immediately adjacent screw, and;

placing the material to be desintegrated in contact with the screws whereby the disintegrating edges of the threads grip and cut into the material to be disintegrated, in opposite directions.

2. The method according to claim 1 wherein the degree of disintegration is controlled by adjustment of the distance between the screws.

3. The method according to claim 1 or claim 2 wherein the material is caused to pass through a plurality of sets of co-operating screws sequentially, each set in said sequence having decreasing thread dimensions and decreasing spaces between adjacent threads.

4. A device for producing the disintegration of material, comprising:

a frame;

at least two screws rotatably mounted to the frame in an essentially parallel relationship to one another, said screws having thread edges adapted for disintegration of material, which edges are active in the direction of advancement of the threads when the screws are rotated in a prescribed direction, and each individual screw having a direction of thread advancement, when rotated in its prescribed direction, which is opposite to the direction of thread advancement of any immediately adjacent screw when said screw is rotated in its own prescribed direction, and;

drive means for rotating each screw in its prescribed direction so that the disintegrating edges of the threads of immediately adjacent screws advance in mutually opposite directions.

5. The device according to claim 4, wherein the screws are arranged in co-operating pairs and are supported in displacable bearings, the distances between adjacent bearings being adjustable in a direction perpindicular to the axes of the screws, for the purpose of adjustment of the distances between the screws, whereby the dimensions of the disintegrated material can be adjusted.

6. The device according to claim 4 or claim 5 wherein the thread helices of adjacent screws are arranged in the same direction, and wherein the opposite direction of advancement of immediately adjacent threads is produced by rotating the screws in opposite directions of rotation.

7. The device according to claim 6, wherein said screws have blade-shaped threads which slope in the direction of feed.

8. The device according to claim 7 wherein the edges of the blade-shaped threads are covered with a wear resistant material.

9. The device according to claim 4 or claim 5 wherein the thread helices of adjacent screws are arranged in the opposite direction, and wherein the opposite direction of advancement of any immediately adjacent threads is produced by rotating the screws in same directions of rotation.

10. The device according to claim 9, further comprising a surrounding housing adjacent to the frame, opening at the top to a funnel and having a discharge opening at the bottom.

11. The device according to claim 10, wherein said screws have blade-shaped threads which slope in the direction of feed.

12. The device according to claim 11, wherein the edges of the blade-shaped threads are covered with a wear resistant material.

13. The device according to claim 9, wherein said screws have blade-shaped threads which slope in the direction of feed.

14. The device according to claim 13, wherein the edges of the blade-shaped threads are covered with a wear resistant material.

15. The device according to claim 4 or claim 5, further comprising a surrounding housing adjacent to the frame, opening at the top of a funnel, and having a discharge opening at the bottom.

16. The device according to claim 15, wherein said screws have blade-shaped threads which slope in the direction of feed.

17. The device according to claim 16, wherein the edges of the blade-shaped threads are covered with a wear resistant material.

18. The device according to claim 4 or claim 5, wherein said screws have blade-shaped threads which slope in the direction of feed.

19. The device according to claim 18, wherein the edges of the blade-shaped threads are covered with a wear resistant material.

20. The device according to claim 4 or 5, wherein said screws have blade-shaped threads which slope in the direction of feed.

21. The device according to claim 20, wherein the edges of the blade-shaped threads are covered with a wear resistant material.

* * * * *